US011179019B2

(12) United States Patent
Sayir

(10) Patent No.: US 11,179,019 B2
(45) Date of Patent: Nov. 23, 2021

(54) SPRAY ARRANGEMENT FOR DISHWASHERS

(71) Applicant: Vestel Beyaz Esya Sanayi ve Ticaret Anonim Sirketi, Manisa (TR)

(72) Inventor: Halil Sayir, Manisa (TR)

(73) Assignee: VESTEL BEYAZ ESYA SANAYI VE TICARET ANONIM SIRKETI, Manisa (TR)

( * ) Notice: Subject to any disclaimer, the term of this patent is extended or adjusted under 35 U.S.C. 154(b) by 0 days.

(21) Appl. No.: 16/922,312

(22) Filed: Jul. 7, 2020

(65) Prior Publication Data

US 2021/0007573 A1 Jan. 14, 2021

(30) Foreign Application Priority Data

Jul. 8, 2019 (TR) ..... 2019/10146

(51) Int. Cl.
*A47L 15/23* (2006.01)
*A47L 15/42* (2006.01)

(52) U.S. Cl.
CPC ..... *A47L 15/23* (2013.01); *A47L 15/4221* (2013.01); *A47L 15/4282* (2013.01)

(58) Field of Classification Search
None
See application file for complete search history.

(56) References Cited

U.S. PATENT DOCUMENTS 5,842,492 A 12/1998 Lee
2012/0175431 A1* 7/2012 Althammer ..... B05B 1/20 239/263

* cited by examiner

*Primary Examiner* — Levon J Shahinian
(74) *Attorney, Agent, or Firm* — Steven M. Shape; Dennemeyer & Associates, LLC

(57) ABSTRACT

The spray arrangement according to the present invention which is suitable for use in a dishwasher such that the spray arrangement is located to rotate along a plane parallel to the base of the rack for spraying a cleaning liquid to the dishes, wherein the spray arrangement comprises: the main body (1) in the form of a chamber; the spray arm (2), a part of which extends out of the main body (1), wherein the spray arm (2) has an angled hole (2*a*) thereon, enables the main body (1) to rotate by spraying the cleaning liquid passing through the spray arm (2) through said angled hole (2*a*) by means of a passage opening, and moves backward and forward; the movement mechanism which provides movement of the spray arm (2) by transferring rotational movement of the main body (1) to the spray arm (2); the liquid inlet (1*f*), wherein cleaning liquid received from a source is delivered to the dishes through holes on spray arm (2); the holder bearing (1*a*) which is located above the opening, and guides movement of the spray arm (2), wherein the spray arm (2) is fitted at the space between the holder bearing (1*a*) and the opening; the liquid distribution member (5) through which the cleaning liquid from the liquid inlet (1*f*) is distributed to the spray arm (2); and the delivery line (6) which is in connection with the passage opening and is connected to the liquid distribution member (5) such that the delivery line (6), in the closed position of the spray arm (2), is at an opposite side of the liquid distribution member (5) facing the passage opening, wherein the cleaning liquid reaching the liquid distribution member (5) is transferred to the spray arm (2).

15 Claims, 7 Drawing Sheets

SPRAY ARRANGEMENT FOR DISHWASHERS

CROSS-REFERENCE TO RELATED APPLICATIONS

This application claims priority to Turkish application 2019/10146, filed Jul. 8, 2020, which is hereby incorporated by reference in its entirety.

TECHNICAL FIELD

The present invention relates to spray arrangements for delivering a cleaning liquid onto dishes in dishwashers.

BACKGROUND OF THE INVENTION

Dirty dishes can be cleaned manually under running water. However, with advanced technology, dishwashers have been commonly used for cleaning the dishes. Dishwashers generally comprise at least one cleaning compartment in which dishes are cleaned, at least one door controlling access into this compartment, at least one rack for placing the dishes to the compartment, and at least one spray arrangement for delivering a cleaning liquid (e.g. water and/or detergent water) to the dishes on the rack so as to clean the dishes.

The spray arrangement comprises at least one (preferably, at least two) spray arm on which at least one angled nozzle is provided, wherein the spray arm can rotate around an axis with the effect of water ejected from the angled nozzle (water jet). Rotation of the spray arm ensures that the cleaning liquid is sprayed into a major part of the cleaning compartment. However, especially in dishwashers having a cleaning compartment with quadrilateral section, cleaning liquid is failed to be efficiently delivered to the corners of the cleaning compartment, and dishes which are placed close to that corners cannot be cleaned efficiently. In order to solve said problem, known art includes spray systems comprising a spray arm which is lengthens for the corner areas and shortens for the edge areas, wherein an example of such a spray arrangement is disclosed in U.S. Pat. No. 5,842,492A. In the embodiment disclosed in said document, there is provided a movement line which is formed to extend corner areas of the cleaning compartment, and the spray arm has a telescopic structure in connection with a line. By means of a connection member seated in the movement line, the spray arm is lengthens towards the corner areas when approaching the corner areas and shortens when moving away from the corner areas. Therefore, the cleaning liquid can reach all areas inside the cleaning compartment in a more effective manner. However, use of a movement line requires an extra space inside the cleaning compartment and complicates the usage of system especially for the top spray arm.

Moreover, spray arrangements that can lengthen and shorten without using movement line are also available in the known art. In such systems, the spray arm can be extended with the effect of water ejected from the angled nozzle while approaching the corner areas; however, since water pressure in the spray arrangement is much higher than the pressure that moves the spray arm, the spray arm cannot switch from its lengthened state to shortened state and thus, it gets stuck.

BRIEF DESCRIPTION OF THE INVENTION

The spray arrangement according to the present invention, which is suitable for use in a dishwasher; wherein the dishwasher comprises a cleaning compartment in which the dishes are placed through a rack; such that the spray arrangement is located under and/or above the rack rotatable along a plane parallel to the base of the rack so that a cleaning liquid is sprayed to the dishes, the spray arrangement comprising:

- at least one main body in the form of a chamber;
- at least one spray arm which is in connection with a side of the main body and at least a part of which passes through at least one opening provided at said side of the main body so as to extend out of the main body, wherein the spray arm has at least one angled hole thereon, enables the main body to rotate around an axis by spraying the cleaning liquid passing through the spray arm through said angled hole by means of at least one passage opening provided at the side facing the main body, moves backward and forward towards the center of the main body and away from its center, and brings into a closed position by moving backwards and into an opened position by moving forwards;
- at least one movement mechanism which provides said movement of the spray arm by transferring rotational movement of the main body to the spray arm;
- at least one liquid inlet located at the main body, wherein cleaning liquid received from a source is passed through the liquid inlet and delivered to the spray arm and also to the dishes through holes on spray arm;
- at least one holder bearing which is located above the opening, forms an arch shape above the opening and guides said movement of the spray arm, wherein the spray arm is movably fitted at the space between the holder bearing and the opening;
- at least one liquid distribution member which can rotate around said axis during the forward-backward movement of the spray arm and has a closed chamber shape in connection with the liquid inlet from a side thereof, wherein the cleaning liquid from the liquid inlet is collected in the liquid distribution member and distributed to the spray arm; and
- at least one delivery line which has a flexible form, is in connection with the passage opening from one side and connected to the liquid distribution member from another side such that the delivery line, in the closed position of the spray arm, is at an opposite side of the liquid distribution member facing the passage opening, wherein the cleaning liquid received from the liquid inlet and reaching the liquid distribution member is passed through the delivery line and transferred to the spray arm.

Thanks to the spray arrangement according to the present invention, cleaning liquid can be effectively delivered to a major part of the inner volume of the cleaning compartment, and dishes can be cleaned more efficiently and efficiently. Further, extendable/retractable spray arm is moved without using an external energy such as electricity; and the stuck problem that may occur while the spray arm, which is in the opened position during this movement, switches to the closed position can be solved in a simple and practical way by using the flexible delivery line. Therefore, an easy to use, cost-effective, practical and reliable spray arrangement can be achieved.

OBJECT OF THE INVENTION

An object of the present invention is to provide a spray arrangement for delivering a cleaning liquid effectively onto dishes placed at a cleaning compartment of the dishwasher.

Another object of the present invention is to provide a spray arrangement having a spray arm which lengthens as it approaches corner areas of cleaning compartment and becomes shorter when corner areas are passed.

A further object of the present invention is to provide a spray arrangement which allows both the dishes in the upper rack and the dishes in the lower rack to be cleaned effectively.

Another object of the present invention is to provide a spray arrangement having a spray arm which can lengthen/shorten without requiring an extra space.

Yet a further object of the present invention is to provide a spray arrangement in which the spray arm is prevented from getting stuck after lengthening.

Another object of the present invention is to provide an easy to use, cost-effective, practical and reliable spray arrangement.

DESCRIPTION OF THE DRAWINGS

Exemplary embodiments of the spray arrangement according to the present invention are illustrated in the attached drawings, in which.

Figure 1:
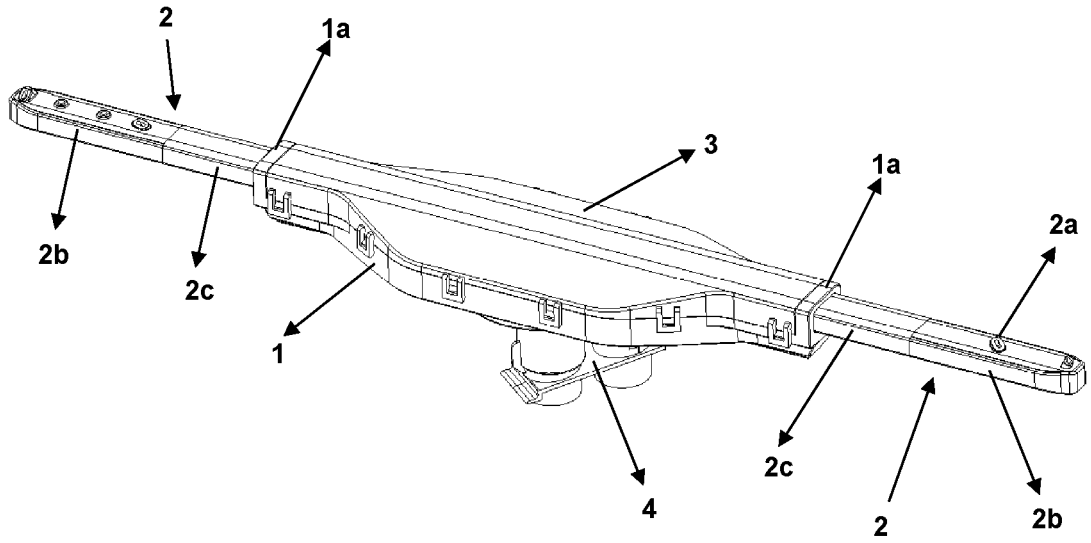
FIG. 1 is a perspective view of the spray arrangement according to the present invention.
Figure 2:
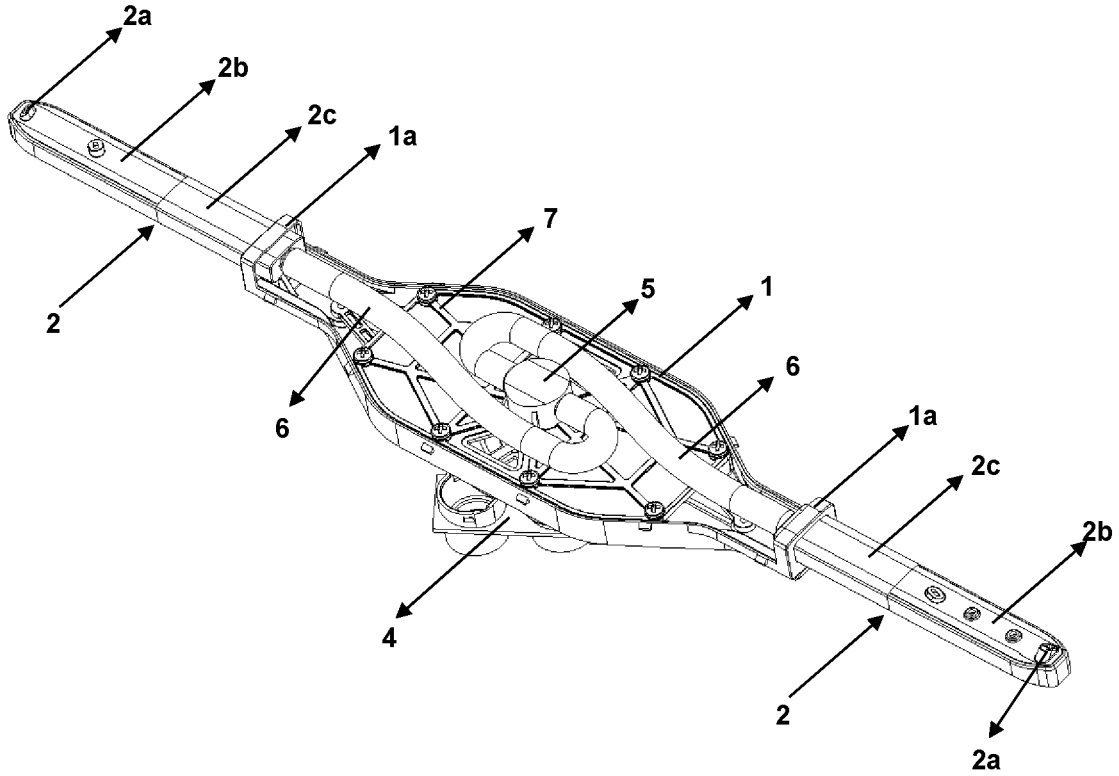
FIG. 2 is a perspective view of the spray arrangement according to the present invention in a semi-assembled state.

All the parts illustrated in figures are individually assigned a reference numeral and the corresponding terms of these numbers are listed below:

| | |
|---|---|
| Main body | (1) |
| Holder bearing | (1a) |
| First housing | (1b) |
| Second housing | (1c) |
| Connection member | (1d) |
| Movement channel | (1e) |
| Liquid inlet | (1f) |
| Spray arm | (2) |
| Angled hole | (2a) |
| Spray member | (2b) |
| Movement member | (2c) |
| Cover | (3) |

-continued

| | |
|---|---|
| Movement bearing | (4) |
| Connection slot | (4a) |
| Lug slot | (4b) |
| Liquid distribution member | (5) |
| Collection portion | (5a) |
| Distributing channel | (5b) |
| Delivery line | (6) |
| Intermediate cover | (7) |
| Fixed gear | (8) |
| Inlet portion | (8a) |
| Fixing portion | (8b) |
| First transfer member | (9) |
| First transfer body | (9a) |
| Movable gear | (9b) |
| Fourth connection section | (9c) |
| Sixth connection section | (9d) |
| Second transfer member | (10) |
| Second transfer body | (10a) |
| Fifth connection section | (10b) |
| Second chamber | (c1) |
| Delivery channel | (c2) |
| Third connection section | (c3) |
| Guide member | (c4) |
| Connection body | (c5) |
| First chamber | (b1) |
| First connection section | (b2) |

DESCRIPTION OF THE INVENTION

Currently, dishwashers are widely used to clean dishes. Dishwashers comprise a cleaning compartment with quadrilateral section, and dirty dishes are placed at the cleaning compartment via a rack. There is provided at least one spray arrangement in the cleaning compartment, the spray arrangement being located under and/or above the rack and rotating around an axis, preferably along a plane parallel to the base of the rack, so that a cleaning liquid is sprayed onto the dishes. The spray arrangement rotates around said axis with the effect of the liquid sprayed through an angled hole provided on a spray arm thereof and enables the cleaning liquid to reach any possible area within the cleaning compartment. However, due to quadrilateral section of the cleaning compartment, sufficient amount of cleaning liquid cannot be sprayed especially onto corner areas of the cleaning compartment, and the dishes close to those corner areas cannot be cleaned efficiently. Prior art applications for solving said problem accommodate various limitations in terms of usage and/or these applications may cause a severe cost increase and/or remain incapable of cleaning the dishes properly. Within this context, the present invention provides a spray assembly for solving said problems.

The spray arrangement according to the present invention, as illustrated in FIGS. 1-13, is suitable for use in a dishwasher; wherein the dishwasher comprises a cleaning compartment in which the dishes are placed through a rack; such that the spray arrangement is located under and/or above the rack rotatable along a plane parallel to the base of the rack so that a cleaning liquid is sprayed to the dishes, the spray arrangement comprising: at least one main body (1) in the form of a chamber; at least one spray arm (2) which is in connection with a side of the main body (1) and at least a part of which passes through at least one opening provided at said side of the main body (1) so as to extend out of the main body (1), wherein the spray arm (2) has at least one angled hole (a water jet) (2*a*) thereon, enables the main body (1) (accordingly, itself) to rotate around an axis by spraying the cleaning liquid passing through the spray arm (2) through said angled hole (2*a*) by means of at least one passage opening provided at the side facing the main body (1) (e.g. facing the center of the main body (1)), moves towards the center of the main body (1) (backward direction) and away from its center (forward direction), and brings into a closed position by moving backwards and into an opened position by moving forwards (in the closed position, part of the spray arm (2) extending out of the opening is the shortest, and in the opened position, part of the spray arm (2) extending out of the opening is the longest); at least one movement mechanism which is preferably located in the main body (1) and provides said movement of the spray arm (2) by transferring rotational movement of the main body (1) to the spray arm (2); and at least one liquid inlet (1*f*) located at the main body (1), wherein cleaning liquid received from a source is passed through the liquid inlet (1*f*) and delivered to the spray arm (2) and also to the dishes through holes on spray arm (2). The spray arrangement according to the present invention also comprises at least one holder bearing (1*a*) which is located above the opening, forms an arch shape above the opening and guides said movement of the spray arm (2), wherein the spray arm (2) is movably fitted at the space between the holder bearing (1*a*) and the opening; at least one liquid distribution member (5) which can rotate around said axis during the forward-backward movement of the spray arm (2) and has a closed chamber shape in connection with the liquid inlet (1*f*) from a side thereof, wherein the cleaning liquid from the liquid inlet (1*f*) is collected in the liquid distribution member (5) and distributed to the spray arm (2); and at least one delivery line (e.g. a hose) (6) which has a flexible form (i.e. it can be bent/folded but does not change in size), is in connection with the passage opening from one side and connected to the liquid distribution member (5) from another side such that the delivery line (6), in the closed position of the spray arm (2), is at an opposite side of the liquid distribution member (5) facing the passage opening (i.e. connected to a side not facing the passage opening), wherein the cleaning liquid received from the liquid inlet (1*f*) and reaching the liquid distribution member (5) is passed through the delivery line (6) and transferred to the spray arm (2).

In an exemplary embodiment of the spray arrangement according to the present invention, as illustrated in figures, the spray arrangement comprises at least two spray arms (2) located facing each other, and at least two delivery lines (6) each of which is connected to a spray arm (2). During a cleaning process upon operating the dishwasher (e.g. during prewash, main wash and/or rinsing), the cleaning liquid received into the spray arrangement through the liquid inlet (1*f*) reaches the liquid distribution member (5) and moves to the delivery lines (6) which are connected to the spray arms (2). Then, the cleaning liquid which has moved through the delivery lines (6) reaches the spray arms (2), passes through the spray arms (2) and is sprayed through the holes on the spray arms (2) towards the dishes located in the dishwasher. Spraying the cleaning liquid through angled holes (2*a*) provided on the spray arms (2) causes the main body (1) to rotate around said axis, and with this rotational movement of the main body (1), the movement mechanism moves the spray arms (2), which are e.g. in the closed position, in the forward direction to bring the spray arms (2) into the opened position (on the contrary, it can also move the spray arms (2), which are in the open position, in the backward direction to ensure that the spray arms (2) is brought into the closed position). With rotational movement of the main body (1), the spray arms (2) lengthen as they approach corner areas of the cleaning compartment (more portion thereof extend out of the main body (1)); and when they are exactly aligned with the corner areas (for example, when they are positioned such that they fit perfectly with the diagonal of the cleaning compartment), they reach the opened position in which the extending part is maximum. The spray arms, which start to move away from the corner area as the main body (1) continues to rotate, move backwards via the movement mechanism, and preferably, when they reach middle of the two successive corner areas, the spray arms (2) will have reached the closed position. As the main body (1) continues to perform its rotational movement, the spray arms (2) in the closed position start to move forwards, and when they are aligned with another corner area, they will have reached the opened position. Therefore, as the main body (1) continues to rotate, the spray arms (2) also move between closed/opened positions, thus the spray arms (2) are enabled to have the longest length when they are aligned with the exact corner areas and have the shortest length when they are aligned with middle areas of the lateral sides, so that dishes inside the cleaning compartment having quadrilateral section can be cleaned efficiently. In addition, movement of spray arms (2) is performed without an external energy (e.g. electric energy), thus avoiding an increase in the energy consumption. However, since movement of spray arms (2) are enabled by rotational movement of main body (1) (i.e. by the thrust of the liquid sprayed through the angled hole (2) and rotating the main body (1)); in order for main body (1) to continue to rotate when the spray arms (2) have the longest length, i.e. in the opened position, it is required that the pressure inside spray arms (2) and delivery lines (6) are overcome and that volume of the spray arrangement is decreased by moving the spray arms (2) backwards. Therefore, a great force is required for this movement and the rotating force of the liquid sprayed through the angled holes (2*a*) may not be enough to overcome said pressure because liquid pressure inside spray arrangement is greater than the force generating a rotation force and sprayed out of the angled holes (2*a*). For that reason, the spray arms (2) may be stuck in the longest position, which may cause the main body (1) to be incapable of rotating. With the aim of solving said problem, there are used delivery lines (6) which have a flexible form and a sufficient length in a way not to prevent the movement of the spray arms (2), and the cleaning liquid received from the liquid inlet (1*f*) is delivered to the spray arms (2) by these delivery lines (6) whose volume remain unchanged. By this way, parts in which the liquid delivery is carried out in the spray arrangement have a constant volume (i.e. the volume of the parts filled with cleaning liquid does not change) and hence the stuck problem can be avoided. In addition, thanks to the spray arrangement according to the invention, additional equipment that require extra space in the cleaning compartment for the movement of spray arms (2) are no longer required, and the spray arrangement can be used efficiently for both the lower rack and the upper rack.

In an alternative embodiment of the invention, the spray arrangement according to the invention preferably comprises at least one cover (3) which is located between the holder bearings (1*a*) and covers the main body (1) to form a closed chamber structure with the main body (1). Therefore, movable spray arm (2) and delivery line (6) are prevented from being displaced unintentionally and moving away from the main body (1) during movement.

Figure 8:
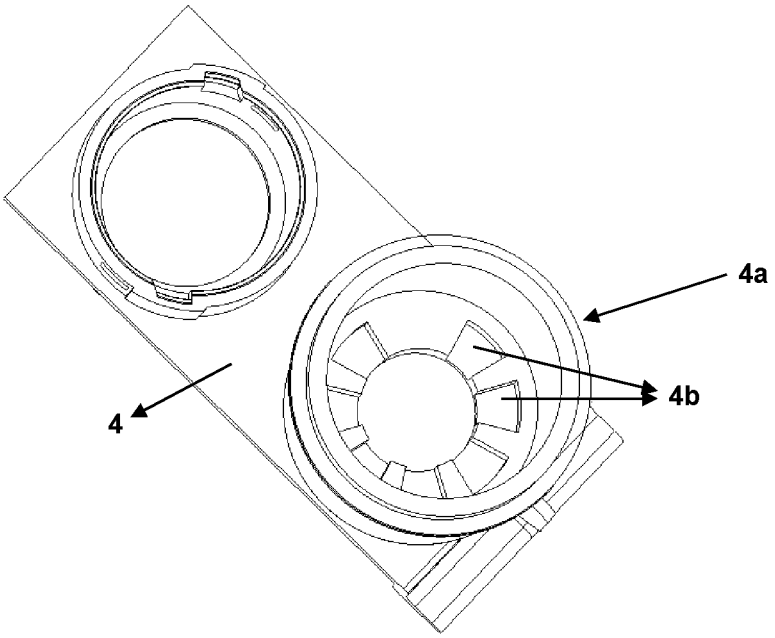
FIG. 8 is a perspective view of a movement bearing of the spray arrangement according to the present invention.
Figure 9:
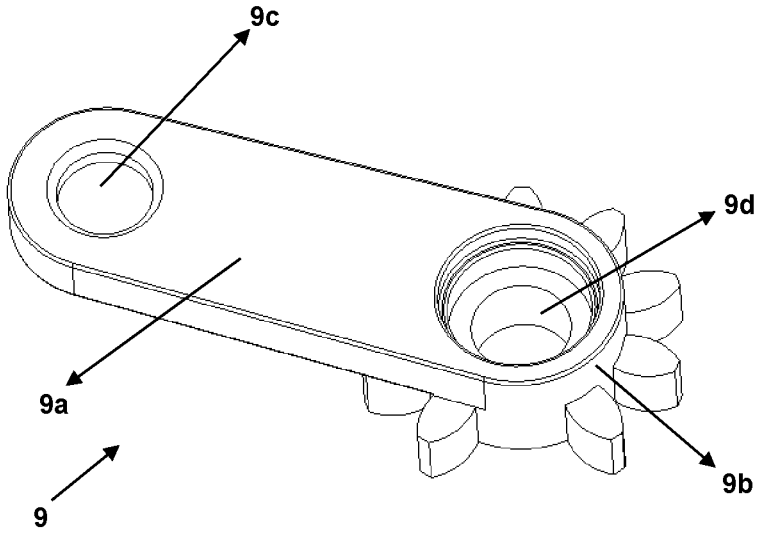
FIG. 9 is a perspective view of a first transfer member of the spray arrangement according to the present invention.
Figure 10:
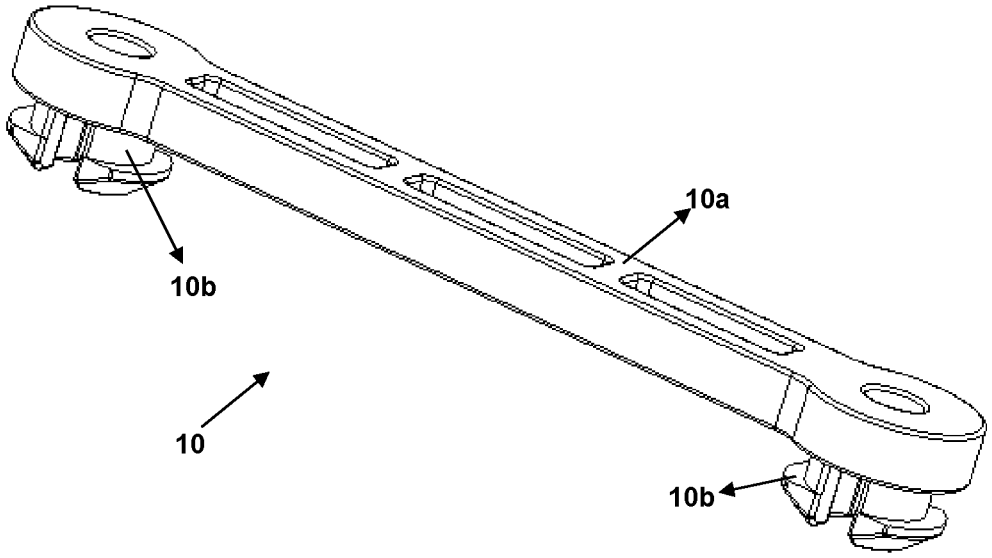
FIG. 10 is a perspective view of a second transfer member of the spray arrangement according to the present invention.
Figure 11:
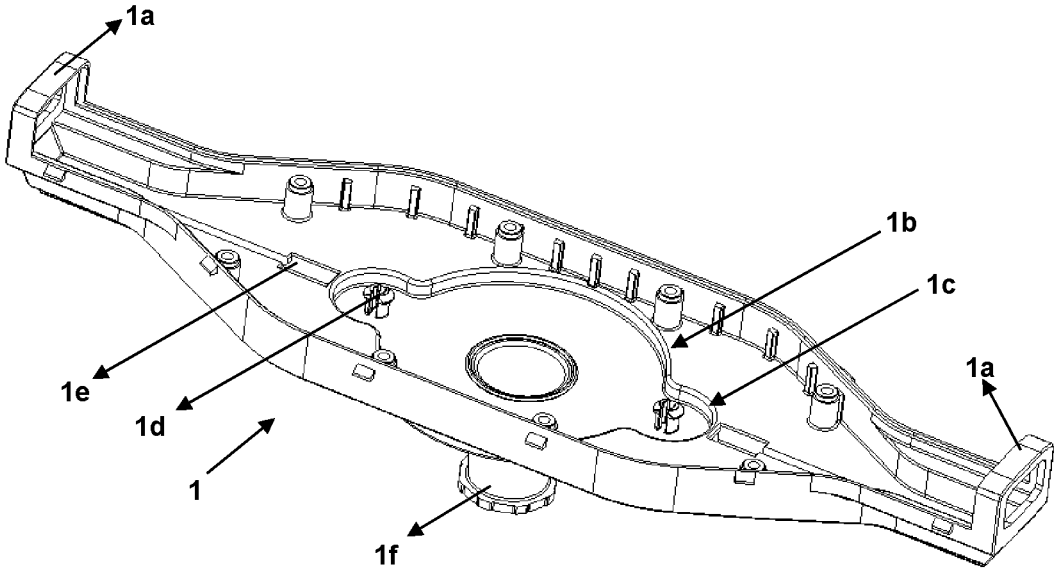
FIG. 11 is a perspective view of a main body of the spray arrangement according to the present invention.

In another exemplary embodiment, the spray arrangement preferably comprises at least one movement bearing (4), as illustrated in FIG. 8, which is suitable for fixing to a surface in the cleaning compartment that is immobile during the operation of the dishwasher (e.g. base of the cleaning compartment, base of the rack where the dishes are placed), wherein the movement bearing (4) is connected to the liquid inlet (1*f*) via at least one connection slot (4*a*) in such a way as to allow rotational movement of the main body (1), thereby bearing the rotational movement of the main body (1), wherein the axis around which the main body (1) rotates passes through the connection slot (4*a*). In this embodiment, preferably, a first side of the connection slot (4*a*) connected to the liquid inlet (1*f*) and a second side opposite to said first side are open, and the second side is suitable for connecting to a liquid source (e.g. to a liquid collection reservoir of the dishwasher). In this embodiment, preferably, the connection slot (4*a*) engages with the liquid inlet (1*f*), and thus, the main body (1) is connected to the movement bearing (4). Cleaning liquid received from the liquid source enters into the connection slot (4) through the opening at the second side, and from there, it passes into the liquid inlet (1). Therefore, the main body (1) is enabled to rotate efficiently such that the liquid inlet is not prevented.

Figure 12:
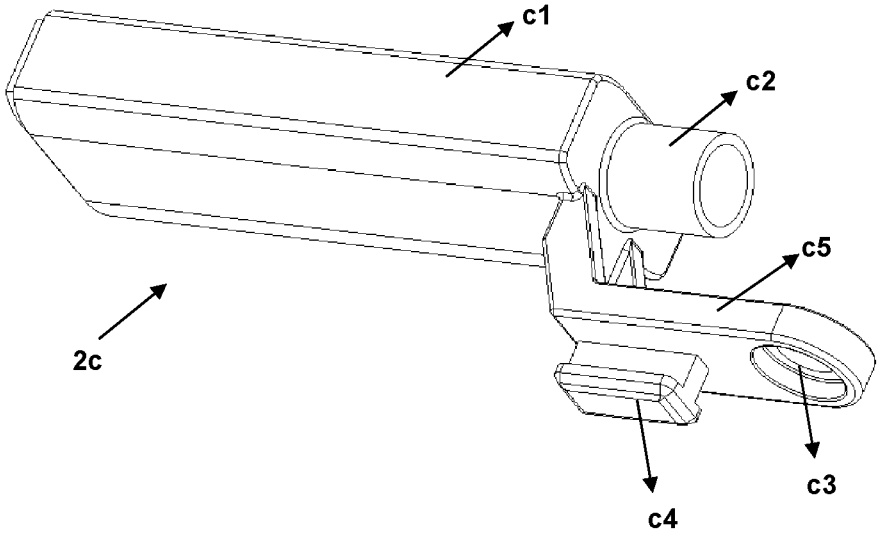
FIG. 12 is a perspective view of a movement member of the spray arrangement according to the present invention.
Figure 13:
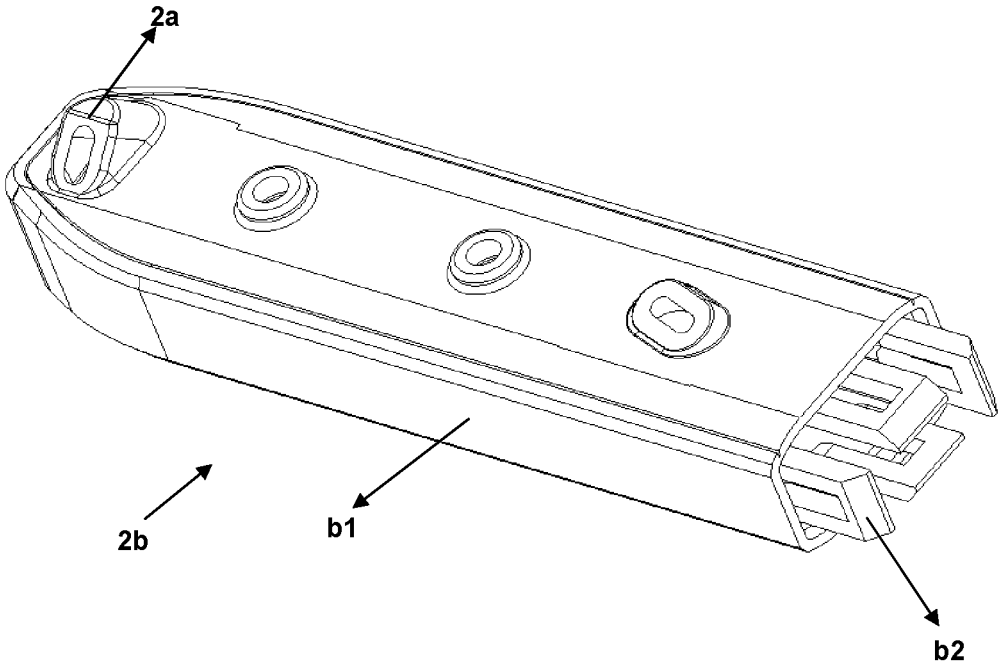
FIG. 13 is a perspective view of a spray member of the spray arrangement according to the present invention.

In another preferred embodiment illustrated in FIGS. 12 and 13, the spray arm (2) comprises at least one spray member (2*b*), and at least one movement member (2*c*) which is connected from one side to the spray member (2*b*) and from an opposite side to the movement mechanism and the delivery line (6). The spray member (2*b*) comprises at least a first chamber (b1) which is a hollow structure preferably with a quadrilateral section and on which the angled hole (2*a*) is provided, wherein a first side of the first chamber (b1) is closed and a second side opposite to the first side is opened, and at least a first connection section (b2) preferably in the form of a lug (or a slot) which is located at the second side of the first chamber (b1). The movement member (2*c*), on the other hand, comprises at least a second chamber (c1) which is a hollow structure preferably with a quadrilateral section and a first side of which is open; at least a second connection section which is preferably in the form of a slot (or a lug), located at the first side of the second chamber (c1), and connected to the first connection section (b2) so that the movement member (2*c*) is attached to the spray member (2*b*); at least one delivery channel (c2) which is located at a second side of the second chamber (c1) opposite to the first side thereof and forms the passage opening, wherein the delivery line (6) is connected to the delivery channel (c2); and at least a third connection section (c3) which is preferably in the form of a hole (or a lug), located at the second side of the second chamber (c1) and provides connection to the movement mechanism. Moreover, in this embodiment, there is preferably provided at least one connection body (c5) located at the bottom part of the delivery channel (c2), connected from one end to the second side of the second chamber (c1) and extending towards the center of the main body (1) from another end, wherein the third connection section (c3) is located at a portion of this connection body (c5) extending towards the center of the main body (1). In this embodiment, the spray arrangement also preferably comprises at least one guide member (c4) located at a bottom surface of the connection body (c5) and in the form of a protrusion extending from said bottom surface towards the main body (1), wherein the guide member (c4) is fitted in at least one movement channel (1*e*) located at the base of the main body (1) and extending in the movement direction of the spray arm (2). Therefore, movement of the spray arm (2) can be determined according to needs by means of the length of the movement channel (1*e*), and also the spray arm (2) is enabled to move linearly in a proper way.

Figure 7:
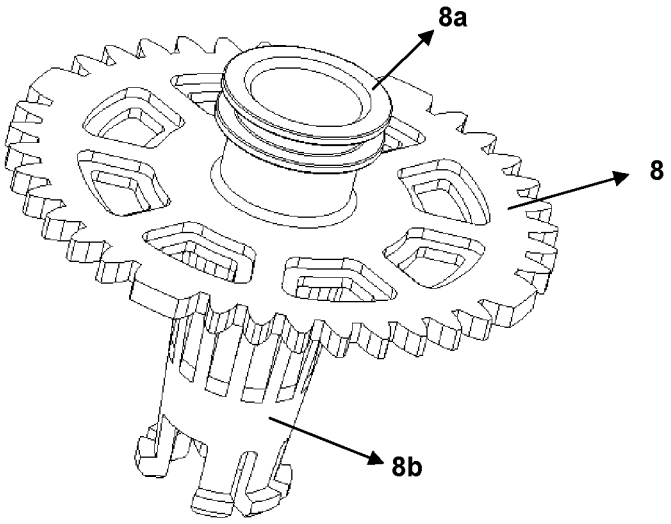
FIG. 7 is a perspective view of a fixed gear of the spray arrangement according to the present invention.

In another embodiment of the spray arrangement according to the invention, the movement mechanism preferably comprises at least one fixed gear (8), as illustrated in FIG. 7, which is located in the main body (1) preferably in at least a first housing (1*b*) with a circular section located at the main body (1) (preferably at the center of the main body (1)), such that the fixed gear (8) coincides with rotational axis of the main body (1) and does not rotate with the rotational movement of the main body (1) (e.g. it is fixed with respect to the main body (1)); and at least a first transfer member (9) which provides connection between the spray arm (2) and the fixed gear (8) and thereby transfers the rotational movement of the main body (1) to the spray arm (2). The first transfer member (9) preferably comprises at least a first transfer body (9*a*) preferably in the form of a rod; at least one movable gear (9*b*) which is located at a bottom surface of a first side of the first transfer body (9*a*) and preferably positioned in at least a second housing (1*c*) at the main body (1) such that the movable gear (9*b*) is connected to a part of the fixed gear (8) closest to the spray arm (2) and rotates together with the main body (1) around its own axis to move around the fixed gear (8), wherein the second housing (1*c*) is preferably located at the main body (1) and is connected from one side to the first housing (1*b*) (i.e. communicates with the first housing (1*b*); and at least a fourth connection section (9*c*) preferably in the form of a hole (or a lug) which is located on a second side of the first transfer body (9*a*) opposite to the first side thereof, and provides connection with the spray arm (2). In this embodiment, the movement arrangement also comprises at least a second transfer member (10) which is rotatably connected from one side to the fourth connection section (9*c*) and rotatably connected from another side to the spray arm (2), preferably to the third connection section (c3) provided at the movement member (2*c*). In this embodiment, with rotation of the main body (1), the movable gear (9*b*) also rotates together with the main body (1) around its own axis because the fixed gear (8) is fixed relative to the main body (1), and with this rotational movement, rotates the first transfer body (9*a*) connected thereto around the axis the movable gear (9*b*) rotates. As a result of rotational movement of the first transfer body (9*a*), the second transfer member (10) rotates, in a plane parallel to the first transfer body (9*a*), around an axis passing through the fourth connection section (9*c*) Similarly, the second transfer member (10) rotates in said plane around an axis passing through the portion at which it is connected to the spray arm (2), thus enabling forward-backward movement of the spray arm (2). Therefore, rotational movement of the main body (1) can be transferred to the spray arm (2). The second transfer member (10) preferably comprises at least a second transfer body (10*a*) in the form of a rod; and at least two fifth connection sections (10*b*) which are in the form of a lug (or a hole) and are located at the lower surface on opposite sides (preferably on two ends facing each other) of the longitudinal axis of the second transfer body (10*a*), wherein the second transfer member (10) is connected to the first transfer member (9) (to the fourth connection section (9*c*)) and to the spray arm (2) (to the third connection section (c3)) so as to rotate around axes passing through the fifth connection sections (10*b*). In this embodiment, the spray arrangement also preferably comprises at least one connection member (1*d*) which is located at the base of the main body (1) (preferably in the second housing (1*c*)) and is in the form of a lug extending upwards from the base of the main body (1), wherein the first transfer member (9) comprises at least a sixth connection section (9*d*) which is located at the portion where the movable gear (9*b*) is provided, and is in the form of a through hole comprising the rotational axis of the movable gear (9*b*), wherein the connection member (1*d*)

is placed in the sixth connection section (9*d*) and forms rotational axis of the movable gear (9*b*). In another alternative, the fixed gear (8) preferably comprises at least one hole located substantially at the center thereof; and at least one inlet portion (8*a*) which is a hollow structure preferably with a cylindrical form, connected to an upper part of the hole and connected from another side to the liquid distribution member (5) such that the liquid distribution member (5) can rotate around the axis around which the main body (1) rotates (preferably communicating with the collection portion (5*a*)). In this embodiment, the spray arrangement further comprises the movement bearing (4); and a plurality of lug slots (4*b*) are provided in the connection slot (4*a*). Moreover, the fixed gear (8) also preferably comprises at least one fixing portion (8*b*) which is a hollow structure and is connected to a bottom part of the hole thereof, settled at the connection slot (4*a*), has a plurality of lugs attached to the lug slots (4*b*), fixes the fixed gear (8) by the lugs settling in the lug slots (4*b*) and thus prevents the fixed gear (8) from rotating with the rotation of the main body (1). In this embodiment, cleaning liquid received from the liquid source passes from the connection slot (4*a*) into the fixing portion (8*b*), from where it reaches the inlet portion (8*a*) and goes to the liquid distribution member (5). At the same time, the fixed gear (8) is prevented from rotating with respect to the main body (1), and rotational movement of the main body (1) is transferred to the spray arm (2) without requiring an external energy. In this embodiment, distance between two successive lug slots (4*b*) is greater than distance between the other successive lug slots (4*b*). Likewise, distance between two successive lugs located in the fixing portion (8*b*) is greater than distance between the other successive lugs. Therefore, it can be ensured that fixed gear (8) is positioned in the main body (1) properly and the spray arm (2) is the longest and shortest in the correct regions. Furthermore, in this embodiment, among the teeth provided on the fixed gear (8), four teeth with an angle of 45° in between are wider than the other teeth (for example, total width of other two teeth). Accordingly, distance between two successive teeth on the movable gear (9*b*) is greater than distance between the other successive teeth such that wider teeth on the fixed gear (8) can fit. Thus, it is possible to assemble the fixed gear (8) and the first transfer member (9) correctly such that the spray arm (2) is the longest or shortest in the correct areas. Preferably, the fixed disk (8) is 4 times the size of the movable disk (9*b*). Therefore, when aligned with the corner areas the spray arm (2) is in the open position in which it is the longest, and when in the middle area between the successive corners, it is in the closed position in which it is the shortest.

Figure 3:
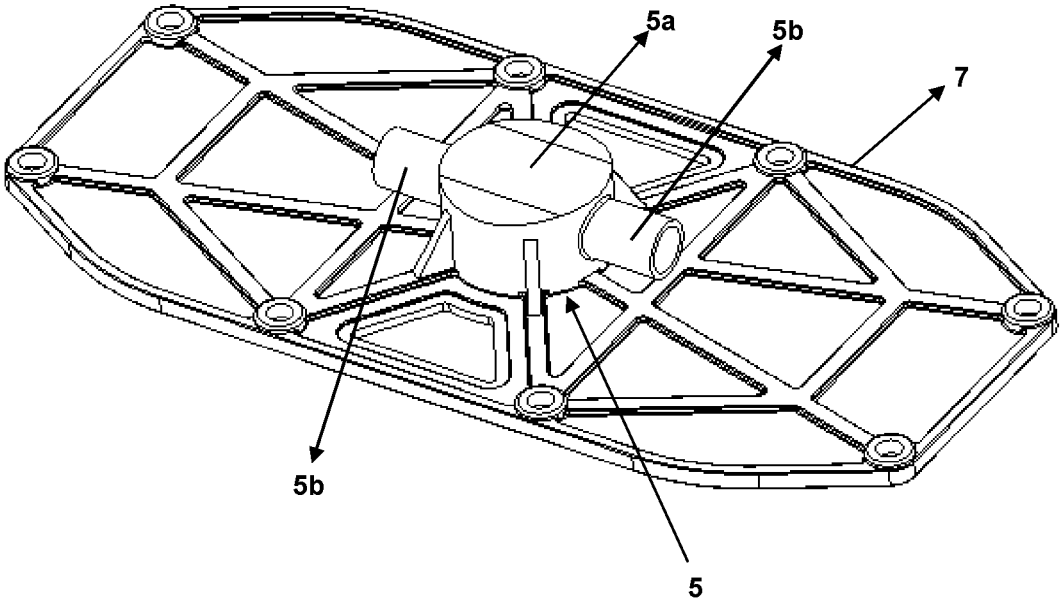
FIG. 3 is a perspective view of an intermediate cover of the spray arrangement according to the present invention.
Figure 4:
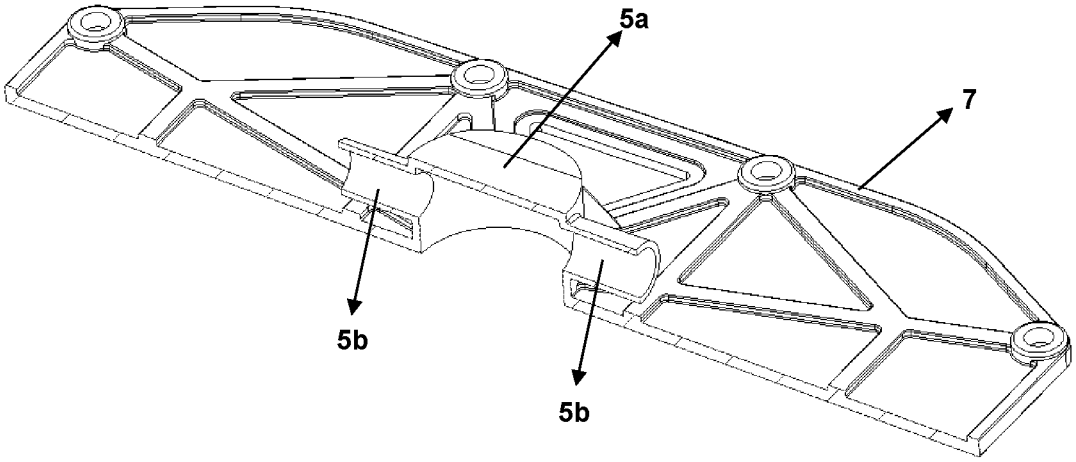
FIG. 4 is a sectional perspective view of the intermediate cover of the spray arrangement according to the present invention.
Figure 5:
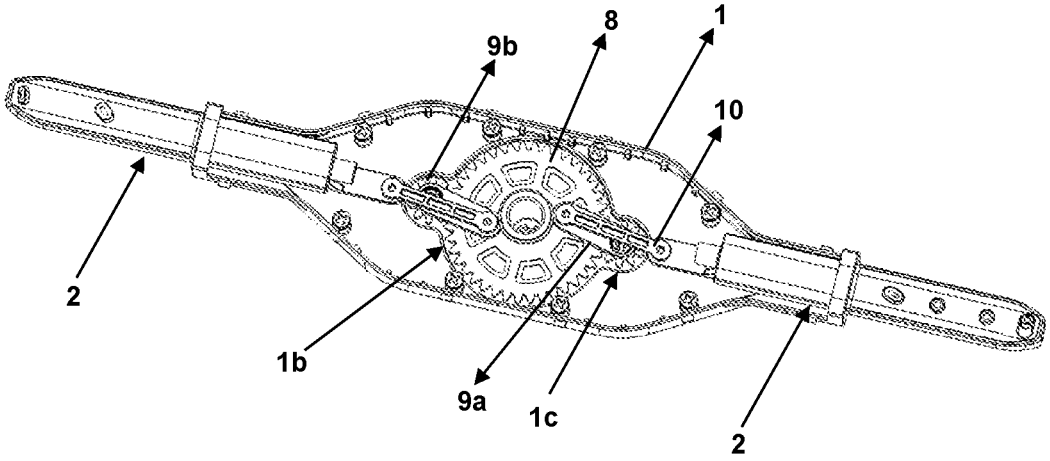
FIG. 5 is another perspective view of the spray arrangement according to the present invention in a semi-assembled state.
Figure 6:
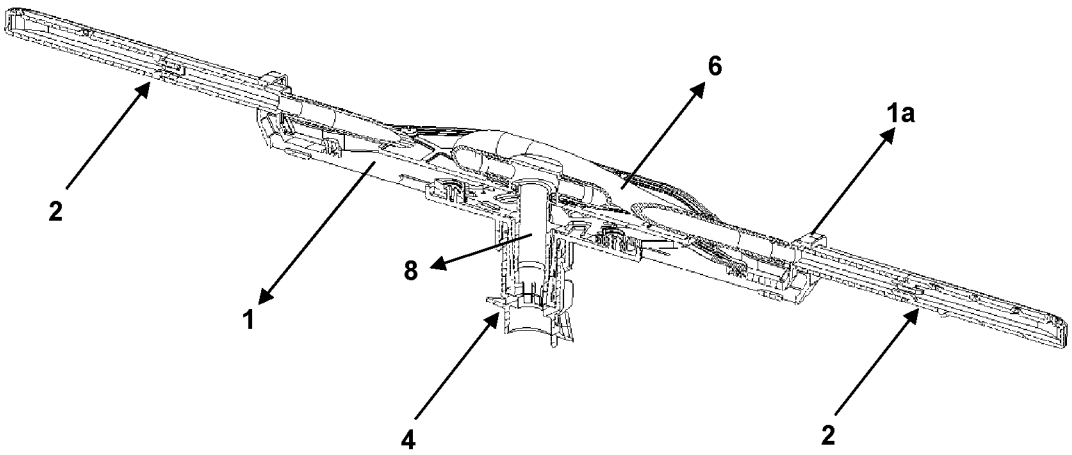
FIG. 6 is a sectional perspective view of the spray arrangement according to the present invention.

In another exemplary embodiment illustrated in FIGS. 3 and 4, the spray arrangement preferably comprises at least one intermediate cover (7) which is located at the main body (1) in the bottom part of the delivery line (6), wherein the liquid distribution member (5) is located at the intermediate cover (7) Thanks to the intermediate cover (7) preferably in the form of a grid, the flexible delivery line (6) can be prevented from contacting other parts of the main body (1) while moving by the movement of the spray arm (2), thus the delivery line (6) and the other parts can be more durable.

Thanks to the spray arrangement according to the present invention, cleaning liquid can be effectively delivered to a major part of the inner volume of the cleaning compartment, and dishes can be cleaned more efficiently and efficiently. Further, extendable/retractable spray arm (2) is moved without using an external energy such as electricity; and the stuck problem that may occur while the spray arm (2), which is in the opened position during this movement, switches to the closed position can be solved in a simple and practical way by using the flexible delivery line (6). Therefore, an easy to use, cost-effective, practical and reliable spray arrangement can be achieved.

The invention claimed is:

1. A spray arrangement which is suitable for use in a dishwasher; wherein the dishwasher comprises a cleaning compartment in which the dishes are placed through a rack; such that the spray arrangement is located under and/or above the rack rotatable along a plane parallel to the base of the rack so that a cleaning liquid is sprayed to the dishes, and which comprises:

at least one main body (1) in the form of a chamber;

at least one spray arm (2) which is in connection with a side of the main body (1) and at least a part of which passes through at least one opening provided at said side of the main body (1) so as to extend out of the main body (1), wherein the spray arm (2) has at least one angled hole (2*a*) thereon, enables the main body (1) to rotate around an axis by spraying the cleaning liquid passing through the spray arm (2) through said angled hole (2*a*) by means of at least one passage opening provided at the side facing the main body (1), moves backward and forward towards the center of the main body (1) and away from its center, and brings into a closed position by moving backwards and into an opened position by moving forwards;

at least one movement mechanism which provides said movement of the spray arm (2) by transferring rotational movement of the main body (1) to the spray arm (2);

at least one liquid inlet (1*f*) located at the main body (1), wherein cleaning liquid received from a source is passed through the liquid inlet (1*f*) and delivered to the spray arm (2) and also to the dishes through holes on spray arm (2);

the spray arrangement wherein:

at least one holder bearing (1*a*) which is located above the opening, forms an arch shape above the opening and guides said movement of the spray arm (2), wherein the spray arm (2) is movably fitted at the space between the holder bearing (1*a*) and the opening;

at least one liquid distribution member (5) which can rotate around said axis during the forward-backward movement of the spray arm (2) and has a closed chamber shape in connection with the liquid inlet (1*f*) from a side thereof, wherein the cleaning liquid from the liquid inlet (1*f*) is collected in the liquid distribution member (5) and distributed to the spray arm (2); and at least one delivery line (6) which has a flexible form, is in connection with the passage opening from one side and connected to the liquid distribution member (5) from another side such that the delivery line (6), in the closed position of the spray arm (2), is at an opposite side of the liquid distribution member (5) facing the passage opening, wherein the cleaning liquid received from the liquid inlet (1*f*) and reaching the liquid distribution member (5) is passed through the delivery line (6) and transferred to the spray arm (2).

2. A spray arrangement according to claim 1, wherein the movement mechanism is located in the main body (1).

3. A spray arrangement according to claim 1, wherein the delivery line (6) is a hose.

4. A spray arrangement according to claim 1, wherein the spray arrangement comprises at least one cover (3) which is located between the holder bearings (1*a*) and covers the main body (1) to form a closed chamber structure with the main body (1).

5. A spray arrangement according to claim 1, wherein the spray arrangement comprises at least one movement bearing (4) which is suitable for fixing to a surface in the cleaning compartment that is immobile during the operation of the dishwasher, wherein the movement bearing (4) is connected to the liquid inlet (1*f*) via at least one connection slot (4*a*) in such a way as to allow rotational movement of the main body (1), thereby bearing the rotational movement of the main body (1), wherein a first side of the connection slot (4*a*) connected to the liquid inlet (1*f*) and a second side opposite to said first side are open, and the second side is connected to a liquid source.

6. A spray arrangement according to claim 1, wherein the spray arm (2) comprises:

at least one spray member (2*b*) which comprises at least a first chamber (b1) which is a hollow structure and on which the angled hole (2*a*) is provided, wherein a first side of the first chamber (b1) is closed and a second side opposite to the first side is open, and at least a first connection section (b2) which is located at the second side of the first chamber (b1); and at least one movement member (2*c*) which is connected from one side to the spray member (2*b*) and from an opposite side to the movement mechanism and the delivery line (6), the movement member (2*c*) comprising: at least a second chamber (c1) which is a hollow structure and a first side of which is open; at least a second connection section which is located at the first side of the second chamber (c1), and connected to the first connection section (b2) so that the movement member (2*c*) is attached to the spray member (2*b*); at least one delivery channel (c2) which is located at a second side of the second chamber (c1) opposite to the first side thereof and forms the passage opening, wherein the delivery line (6) is connected to the delivery channel (c2); and at least a third connection section (c3) which is located at the second side of the second chamber (c1) and provides connection to the movement mechanism.

7. A spray arrangement according to claim 6, wherein the spray arrangement comprises at least one connection body (c5) located at the bottom part of the delivery channel (c2), connected from one end to the second side of the second chamber (c1) and extending towards the center of the main body (1) from another end, wherein the third connection section (c3) is located at a portion of the connection body (c5) extending towards the center of the main body (1); at least one guide member (c4) located at a bottom surface of the connection body (c5) and in the form of a protrusion extending from said bottom surface towards the main body (1); and at least one movement channel (1*e*) in which the guide member (c4) is fitted and which is located at the base of the main body (1) and extends in the movement direction of the spray arm (2).

8. A spray arrangement according to claim 1, wherein the movement mechanism comprises:

at least one fixed gear (8) which is provided in the main body (1) such that the fixed gear (8) coincides with rotational axis of the main body (1) and does not rotate with the rotational movement of the main body (1), the fixed gear (8) being located in at least a first housing (1*b*) with a circular section, which is provided at the main body (1);

at least a first transfer member (9) which provides connection between the spray arm (2) and the fixed gear (8) and thereby transfers the rotational movement of the main body (1) to the spray arm (2); and at least a second transfer member (10) which is rotatably connected from one side to the fourth connection section (9*c*) and rotatably connected from another side to the spray arm (2).

9. A spray arrangement according to claim 8, wherein the first transfer member (9) comprises:

at least a first transfer body (9*a*);

at least one movable gear (9*b*) which is located at a bottom surface of a first side of the first transfer body (9*a*) and positioned at the main body (1) such that the movable gear (9*b*) is connected to a part of the fixed gear (8) closest to the spray arm (2) and rotates together with the main body (1) around its own axis to move around the fixed gear (8), wherein the movable gear (9*b*) is provided in at least a second housing (1*c*) which is located at the main body (1) and is connected from one side to the first housing (1*b*); and at least a fourth connection section (9*c*) which is located on a second side of the first transfer body (9*a*) opposite to the first side thereof, and provides connection with the spray arm (2).

10. A spray arrangement according to claim 9, wherein the spray arrangement comprises at least one connection member (1*d*) which is in the form of a lug extending upwards from the base of the main body (1), located at the base of the main body (1), and positioned in a second housing (1*c*) which is located at the main body (9) and in which the movable gear (9*b*) is provided; and that the first transfer member (9) comprises at least a sixth connection section (9*d*) which is located at the portion where the movable gear (9*b*) is provided and is in the form of a through hole comprising the rotational axis of the movable gear (9*b*), wherein the connection member (1*d*) is placed in the sixth connection section (9*d*) and forms rotational axis of the movable gear (9*b*).

11. A spray arrangement according to claim 9, wherein four teeth, among the teeth provided on the fixed gear (8), with an angle of 45° in between are wider than the other teeth, and distance between two successive teeth on the movable gear (9*b*) is greater than distance between the other teeth such that wider teeth on the fixed gear (8) can fit.

12. A spray arrangement according to claim 8, wherein the second transfer member (10) comprises at least a second transfer body (10*a*) in the form of a rod, and at least two fifth connection sections (10*b*) which are located at the lower surface on opposite sides of the longitudinal axis of the second transfer body (10*a*), and that the second transfer member (10) is connected to the first transfer member (9) and the spray arm (2) so as to rotate around axes passing through the fifth connection sections (10*b*).

13. A spray arrangement according to claim 8, wherein:

the fixed gear (8) comprises at least one hole located substantially at the center thereof; at least one inlet portion (8*a*) which is a hollow structure, connected to an upper part of the hole and connected from another side to the liquid distribution member (5) such that the liquid distribution member (5) can rotate around the axis around which the main body (1) rotates;

the spray arrangement comprises at least one movement bearing (4) which is suitable for fixing to a surface in the cleaning compartment that is immobile during the operation of the dishwasher, wherein the movement bearing (4) is connected to the liquid inlet (1*f*) via at least one connection slot (4*a*) in such a way as to allow rotational movement of the main body (1), thereby bearing the rotational movement of the main body (1), wherein a plurality of lug slots (4*b*) are provided in the connection slot (4*a*); and the fixed gear (8) also comprises at least one fixing portion (8*b*) which is a hollow structure and is connected to a bottom part of the hole thereof, fitted at the connection slot (4*a*), has a plurality of lugs attached to the lug slots (4*b*), fixes the fixed gear (8) by the lugs settling in the lug slots (4*b*) and thus prevents the fixed gear (8) from rotating with the rotation of the main body (1).

14. A spray arrangement according to claim 13, wherein distance between two successive lug slots (4*b*) is greater than distance between the other successive lug slots (4*b*) and distance between two successive lugs located in the fixing portion (8*b*) is greater than distance between the other successive lugs.

15. A spray arrangement according to claim 1, wherein the spray arrangement comprises at least one intermediate cover (7) which is located at the main body (1) in the bottom part of the delivery line (6), wherein the liquid distribution member (5) is located at the intermediate cover (7).

* * * * *